US006739007B1

(12) United States Patent
Talai

(10) Patent No.: US 6,739,007 B1
(45) Date of Patent: May 25, 2004

(54) AIR FILLED THERAPEUTIC PILLOW

(75) Inventor: Randi Talai, West Hills, CA (US)

(73) Assignee: Randy Talai, West Hills, CA (US)

( * ) Notice: Subject to any disclaimer, the term of this patent is extended or adjusted under 35 U.S.C. 154(b) by 0 days.

(21) Appl. No.: 10/462,271

(22) Filed: Jun. 16, 2003

(51) Int. Cl.[7] ..... A47C 20/02
(52) U.S. Cl. ..... 5/644; 5/636; 5/654; 5/652
(58) Field of Search ..... 5/636, 644, 630, 5/632, 652, 654, 655.3

(56) References Cited

U.S. PATENT DOCUMENTS 3,965,507 A * 6/1976 Reiland ..... 482/18
4,829,614 A * 5/1989 Harper ..... 5/644
5,432,967 A * 7/1995 Raftery ..... 5/633
5,809,597 A * 9/1998 Shaw ..... 5/655.3
D416,428 S * 11/1999 Jackson ..... D6/604
6,131,219 A * 10/2000 Roberts ..... 5/644
6,397,415 B1 * 6/2002 Hsieh ..... 5/644
6,574,809 B1 * 6/2003 Rathbun ..... 5/636

* cited by examiner

*Primary Examiner*—Teri Pham Luu

(57) ABSTRACT

The air filled therapeutic pillow allows the user to adjust the height or firmness of the pillow to suit their tastes or needs. It can be easily broken down and transported to provide a traveler with comfortable sleep away from home.

14 Claims, 2 Drawing Sheets

AIR FILLED THERAPEUTIC PILLOW

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

FIELD OF INVENTION

The present invention relates to a portable therapeutic pillow, more particularly it relates to an air filled therapeutic pillow that is adapted for easy transport and provides variable support to the head, neck and upper back of the user in a horizontal resting position whether the user is sleeping on her back or her side.

BACKGROUND OF THE INVENTION

Many people suffer from chronic neck pain or stiffness and a tense upper back. This is often the result of sleeping with pillows that provide insufficient support for the neck and upper back. Improper alignment of the spine often occurs when the head and neck are inadequately supported. The muscles of the neck try to compensate for the misalignment resulting a sore or stiff neck.

The natural spinal curves in the cervical, thoracic and lumbar regions are designed to support the weight of the body and to provide flexibility. Spinal bone will remodel itself in response to applied mechanical stresses and strains, according to Wolff's law of osseous physiology. In response to abnormal mechanical forces, living bone will constantly change its growth and orientation. An anterior head carriage posture results from decreased cervical lordosis, which in turn leads to abnormal forward weight bearing on the anterior vertebral bodies and discs. This abnormal forward weight bearing will create disc degeneration and spondylopathy.

In addition, applied force over time will cause a viscous change in the surrounding muscles, ligaments and tendons. Unless a corrective force is applied, again over time, all viscous change is permanent.

Many therapeutic sleep pillows have been developed over the years to provide proper support of the head and neck. Therapeutic sleep pillows allow the user to directly effect the biophysiologic property of viscosity. These pillows allow a force to be applied to the cervical spine in a corrective direction over an extended period of time. These pillows are usually made of open or closed celled foam. There is no way to vary the size, softness or the firmness of these pillows to suit the individual user. The typical user does not have a standard size head, neck or shoulder width. The user with wide shoulders, or a long neck or pressure sensitive ears must cope with a one-size fits all pillow. The user often must resort to modifying the pillow by raising it upon a towel or another pillow or adapting the upper surface to suit their particularly peculiar shaped head or neck size, or firmness needs.

While some users are able to achieve relief at home, they suffer when sleeping away from home. Although conventional pillows can be shaped to provide comfortable support in the position in which the user falls asleep, these pillows do not retain that shape and support throughout the entire sleeping period. The open celled or closed celled, foam therapeutic sleep pillows are too bulky and heavy to be practically taken by travelers.

What is needed is a pillow that allows the user to adjust the height or firmness of the pillow to suit their tastes or needs. What is also needed is a pillow that can be easily broken down and transported to provide the traveler with comfortable sleep away from home.

BRIEF SUMMARY OF THE INVENTION

The invention resides in a fluid filled head support. The fluid filled head support includes a center section. The center section has a proximal face, a distal face, a front face, a back face, a first face and a second face. Each face has at least one edge. Each edge is joined to an adjacent edge at a multiplicity of joining spots to form at least one cell. Each cell is fabricated from a flexible, air impervious material. Each cell has at least one opening therein adapted to selectively open and close for receiving and expelling air. The proximal face has a forward attachment area.

A first neck-support section is provided. The neck-support section has a cylindrical proximal face, a flat distal face, a first end face and a second end face, each face has at least one edge. Each edge is joined to an adjacent edge at a multiplicity of joining spots to form at least one cell. Each cell is fabricated from a flexible, air impervious material. Each cell has at least one opening therein adapted to selectively open and close for receiving and expelling air. The distal face of the first neck-support section is attached to the forward attachment area of the proximal face of the center section.

An upper back-support section is provided. The upper back-support section has a proximal face, a distal face, a back face, a first face and a second face. The distal face has a front edge. The upper back-support section has a wedge shape. Each face has at least one edge. Each edge is joined to an adjacent edge at a multiplicity of joining spots to form at least one cell. Each cell is fabricated from a flexible, air impervious material. Each cell has at least one opening therein adapted to selectively open and close for receiving and expelling air. The back face of the upper back-support section is attached to the front face of the center section. The proximal face slopes up from the front edge of the distal face to form a smooth transition up to the proximal face of the center section.

The center section, first neck-support section and upper back-support section are disposed, sized and shaped to receive and support the rear of a user's head in such a way that the user's neck muscles are in a relaxed state and the spine is in proper orthopedic alignment when the user is laying horizontally on the user's back.

A first side section is provided. The first side section has a proximal face, a distal face, a front face, a back face, a first face and a second face. Each face has at least one edge. Each edge is joined to an adjacent edge at a multiplicity of joining spots to form at least one cell. Each cell is fabricated from a flexible, air impervious material. Each cell has at least one opening therein adapted to selectively open and close for receiving and expelling air. The proximal face has a forward attachment area. The second face of the first side section is attached to the first face of the center section.

A second neck-support section is provided. The second neck-support section has a cylindrical proximal face, a flat distal face, a first end face and a second end face. Each face has at least one edge. Each edge is joined to an adjacent edge at a multiplicity of joining spots to form at least one cell. Each cell is fabricated from a flexible, air impervious material. Each cell has at least one opening therein adapted to selectively open and close for receiving and expelling air. The distal face of the second neck-support section is attached to the forward attachment area of the proximal face of the first side section.

The first side section and the second neck-support section are disposed, sized and shaped to receive and support the side of a user's head in such a way that the user's neck muscles are in a relaxed state and the spine is in proper orthopedic alignment when the user is laying horizontally on the user's side.

A first support section is provided. The first support section has a proximal face, a distal face, a front face, a back face, a first face and a second face. Each face has at least one edge. Each edge is joined to an adjacent edge at a multiplicity of joining spots to form at least one cell. Each cell has at least one opening therein adapted to selectively open and close for receiving and expelling air. Each cell is fabricated from a flexible, air impervious material. The proximal face of the first support section is attached to the distal face of the center section, the distal face of the upper back-support section and the distal face of the first side section.

In a variant of this invention, a second side section provided. The second side section a proximal face, distal face, a front face, back face, a first face and a second face. Each face has at least one edge. Each edge is joined to an adjacent edge at a multiplicity of joining spots to form at least one cell. Each cell is fabricated from a flexible, air impervious material. Each cell has at least one opening therein adapted to selectively open and close for receiving and expelling air. The proximal face has a forward attachment area. The first face of the second side section is attached to the second face of the center section.

A third neck-support section is provided. The third neck-support section has a cylindrical proximal face, a flat distal face, a first end face and a second end face. Each face has at least one edge. Each edge is joined to an adjacent edge at a multiplicity of joining spots to form at least one cell. Each cell is fabricated from a flexible, air impervious material. Each cell has at least one opening therein adapted to selectively open and close for receiving and expelling air. The distal face of the third neck-support section is attached to the forward attachment area of the proximal face of the second side section.

The second side section and third neck-support section are disposed, sized and shaped to receive and support the side of a user's head in such a way that the user's neck muscles are in a relaxed state and the spine is in proper orthopedic alignment when the user is laying horizontally on the user's side.

In yet another variant of this invention, a second support section is provided. The second support section has a proximal face, a distal face, a front face, a back face, a first face and a second face. Each face has at least one edge. Each edge is joined to an adjacent edge at a multiplicity of joining spots to form at least one cell. Each cell has at least one opening therein adapted to selectively open and close for receiving and expelling air. Each cell is fabricated from a flexible, air impervious material. The proximal face of the second support section is attached to the distal face of the first support section.

In still another variant of this invention, the proximal face of the center section, the proximal face of the upper back-support section, the proximal face of the first side section, the proximal face of the second side section, the proximal face of the first neck support, the proximal face of the second neck support and the proximal face of the third neck support are covered by a flocked material. The flocked material is rayon.

In again another variant of this invention, the proximal face of the center section, the proximal face of the upper back-support section, the proximal face of the first side section, the proximal face of the second side section, the proximal face of the first neck support, the proximal face of the second neck support and the proximal face of the third neck support has a tucked configuration.

In a variation of this invention, the proximal face of the center section, the proximal face of the upper back-support section, the proximal face of the first side section, the proximal face of the second side section, the proximal face of the first neck support, the proximal face of the second neck support and the proximal face of the third neck support has a ribbed configuration.

The invention also resides in another fluid filled head support. The other fluid filled head support includes a center section. The center section has a proximal face, a distal face, a front face, a back face, a first face and a second face. Each face has at least one edge. Each edge is joined to an adjacent edge at a multiplicity of joining spots. Each face is fabricated from a flexible, air impervious material. The proximal face has a forward attachment area.

A first neck-support section is provided The neck-support section has a cylindrical proximal face, a flat distal face, a first end face and a second end face. Each face has at least one edge. Each edge is joined to an adjacent edge at a multiplicity of joining spots. Each face is fabricated from a flexible, air impervious material. The distal face of the first neck-support section is attached to the forward attachment area of the proximal face of the center section.

An upper back-support section is provided. The upper back-support section has a proximal face, a distal face, a back face, a first face and a second face. The distal face has a front edge. The upper back-support section has a wedge shape. Each face has at least one edge. Each edge is joined to an adjacent edge at a multiplicity of joining spots. Each face is fabricated from a flexible, air impervious material. The back face of the upper back-support section is attached to the front face of the center section. The proximal face slopes up from the front edge of the bottom face to form a smooth transition up to the proximal face of the center section.

The center section, the first neck-support section and upper back-support section are disposed, sized and shaped to receive and support the rear of a user's head in such a way that the user's neck muscles are in a relaxed state and the spine is in proper orthopedic alignment when the user is laying horizontally on the user's back.

A first side section is provided. The first side section has a proximal face, a distal face, a front face, a back face, a first face and a second face. Each face has at least one edge. Each edge is joined to an adjacent edge at a multiplicity of joining spots. Each face is fabricated from a flexible, air impervious material. The proximal face has a forward attachment area. The second face of the first side section is attached to the first face of the center section.

A second neck-support section is provided. The second neck-support section has a cylindrical proximal face, a flat distal face, a first end face and a second end face. Each face has at least one edge. Each edge is joined to an adjacent edge at a multiplicity of joining spots. Each face is fabricated from a flexible, air impervious material. The distal face of the second neck-support section is attached to the forward attachment area of the proximal face of the first side section.

The first side section and the second neck-support section are disposed, sized and shaped to receive and support the side of a user's head in such a way that the user's neck muscles are in a relaxed state and the spine is in proper orthopedic alignment when the user is laying horizontally on the user's side.

The center section, the upper back-support section, the first side section, the first neck-support section and the second neck-support section are joined to each adjacent section in such a way as to form at least one cell. Each cell has at least one opening therein adapted to selectively open and close for receiving and expelling air.

A first support section is provided. The first support section has a proximal face, a distal face, a front face, a back face, a first face and a second face. Each face has at least one edge. Each edge is joined to an adjacent edge at a multiplicity of joining spots to form at least one cell. Each cell has at least one opening therein adapted to selectively open and close for receiving and expelling air. Each cell is fabricated from a flexible, air impervious material. The proximal face of the first support section is attached to the distal face of the center section, to the distal face of the upper back-support section and to the distal face of the first side section.

In a variant of this invention, a second side section is provided. The second side section has a proximal face, a distal face, a front face, a back face, a first face and a second face. Each face has at least one edge. Each edge is joined to an adjacent edge at a multiplicity of joining spots. Each face is fabricated from a flexible, air impervious material. The proximal face has a forward attachment area. The first face of the second side section is attached to the second face of the center section.

A third neck-support section is provided The third neck-support section has a cylindrical proximal face, a flat distal face, a first end face and a second end face. Each face has at least one edge. Each edge is joined to an adjacent edge at a multiplicity of joining spots. Each face is fabricated from a flexible, air impervious material. The distal face of the third neck-support section is attached to the forward attachment area of the proximal face of the second side section.

The second side section and the third neck-support section are disposed, sized and shaped to receive and support the side of a user's head in such a way that the user's neck muscles are in a relaxed state and the spine is in proper orthopedic alignment when the user is laying horizontally on the user's side.

The center section, the upper back-support section, the first side section, the second side section, the first neck-support section, the second neck-support section and the third neck-support section are joined to each adjacent section in such a way as to form at least one cell. Each cell has at least one opening therein adapted to selectively open and close for receiving and expelling air.

In yet another variant of this invention, a second support section is provided. The second support section has a proximal face, a distal face, a front face, a back face, a first face and a second face. Each face has at least one edge. Each edge is joined to an adjacent edge at a multiplicity of joining spots to form at least one cell. Each cell has at least one opening therein adapted to selectively open and close for receiving and expelling air. Each cell is fabricated from a flexible, air impervious material. The proximal face of the second support section is attached to the distal face of the first support section.

In still another variant of this invention, the proximal face of the center section, the proximal face of the upper back-support section, the proximal face of the first side section, the proximal face of the second side section, the proximal face of the first neck support, the proximal face of the second neck support and the proximal face of the third neck support are covered by a flocked material. The flocked material is rayon.

In again another variant of this invention, the proximal face of the center section, the proximal face of the upper back-support section, the proximal face of the first side section, the proximal face of the second side section, the proximal face of the first neck support, the proximal face of the second neck support and the proximal face of the third neck support have a tucked configuration.

In a variation of this invention, the proximal face of the center section, the proximal face of the upper back-support section, the proximal face of the first side section, the proximal face of the second side section, the proximal face of the first neck support, the proximal face of the second neck support and the proximal face of the third neck support have a ribbed configuration.

The foregoing has outlined the more pertinent and important features of the present invention in order that the detailed description of the invention that follows may be better understood so the present contributions to the art may be more fully appreciated. Additional features of the present invention will be described hereinafter, which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

The invention will be more fully understood by reference to the following drawings that are for illustrative purposes only.

DETAILED DESCRIPTION

Figure 1:
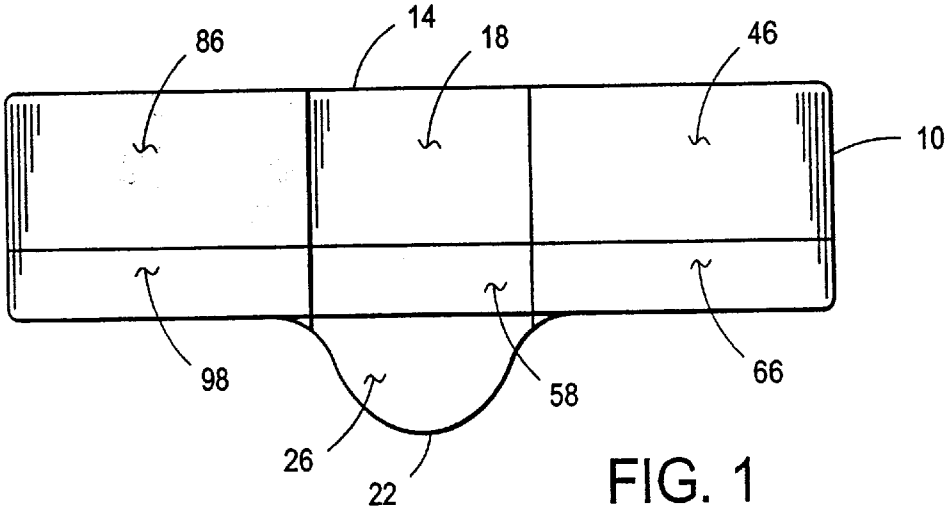
FIG. 1 is a front elevation of the air filled therapeutic pillow.
Figure 2:
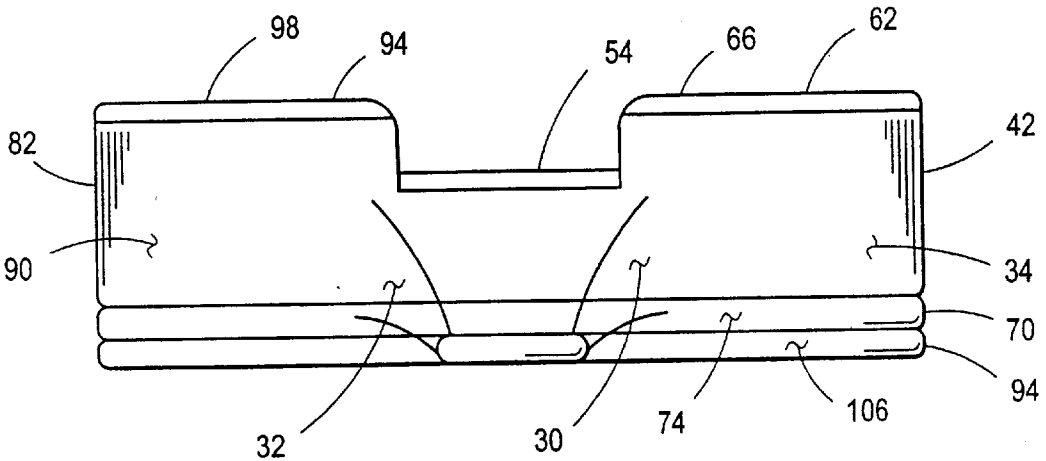
FIG. 2 is a plan view of the air filled therapeutic pillow.
Figure 3:
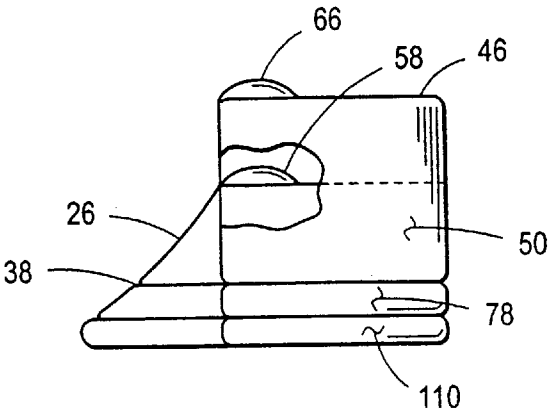
FIG. 3 is a side elevation of the air filled therapeutic pillow.
Figure 6:
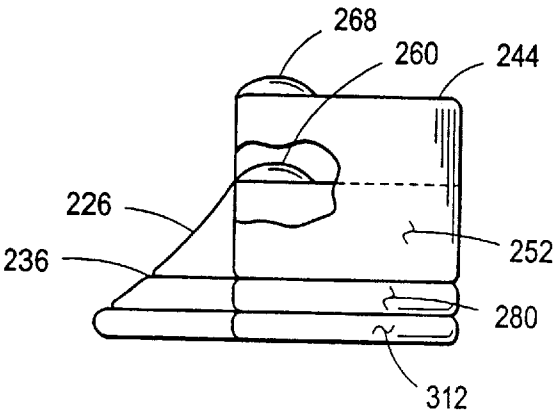
FIG. 6 is a side elevation of the air filled therapeutic pillow.
Figure 4:
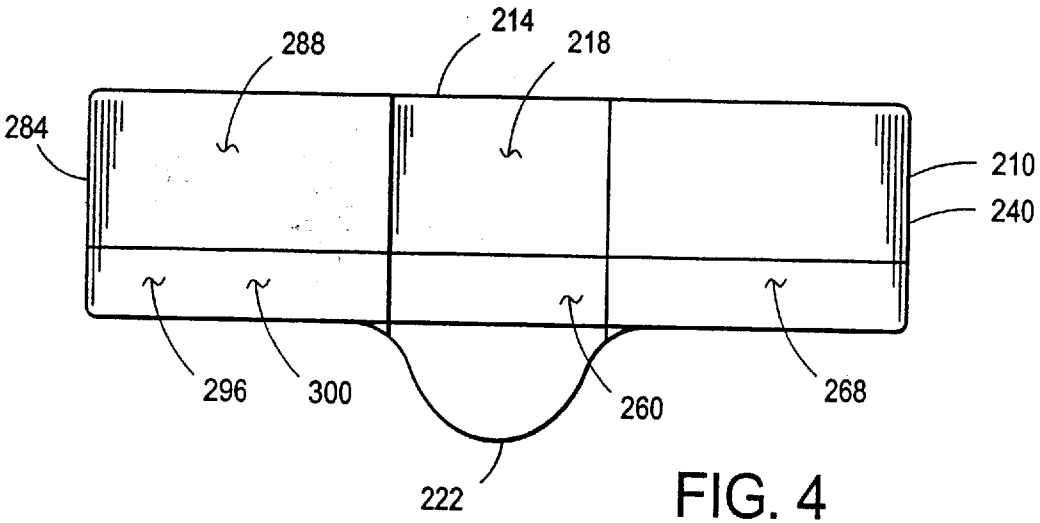
FIG. 4 is a front elevation of the air filled therapeutic pillow.
Figure 5:
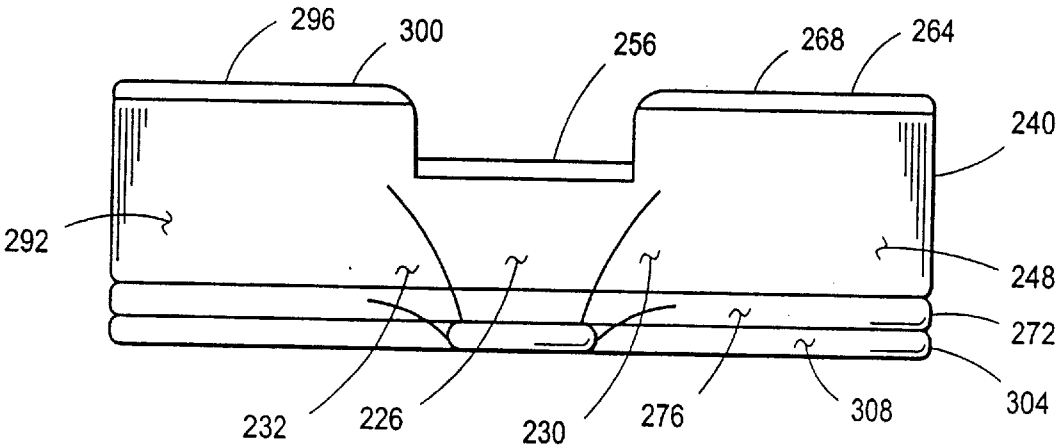
FIG. 5 is a plan view of the air filled therapeutic pillow.

The invention resides in a fluid filled head support 10. The fluid filled head support 10 includes a center section 14. The center section 14 has a proximal face 18, a distal face, a front face, a back face, a first face and a second face. Each face has at least one edge. Each edge is joined to an adjacent edge at a multiplicity of joining spots to form at least one cell. Each cell is fabricated from a flexible, air impervious material. Each cell has at least one opening therein adapted to selectively open and close for receiving and expelling air. The proximal face 18 has a forward attachment area.

A first neck-support section 54 is provided. The neck-support section 54 has a cylindrical proximal face 58, a flat distal face, a first end face and a second end face, each face has at least one edge. Each edge is joined to an adjacent edge at a multiplicity of joining spots to form at least one cell. Each cell is fabricated from a flexible, air impervious material. Each cell has at least one opening therein adapted to selectively open and close for receiving and expelling air. The distal face of the first neck-support section 54 is attached to the forward attachment area of the proximal face 18 of the center section 14.

An upper back-support section 22 is provided. The upper back-support section 22 has a proximal face 26, a distal face, a back face, a first face 30 and a second face 32. The distal face has a front edge 38. The upper back-support section 22 has a wedge shape. Each face has at least one edge. Each edge is joined to an adjacent edge at a multiplicity of joining spots to form at least one cell. Each cell is fabricated from a flexible, air impervious material. Each cell has at least one opening therein adapted to selectively open and close for receiving and expelling air. The back face of the upper back-support section 22 is attached to the front face of the center section 14. The proximal face 26 slopes up from the front edge 38 of the distal face to form a smooth transition up to the proximal face 18 of the center section 14.

The center section 14, first neck-support section 54 and upper back-support section 22 are disposed, sized and shaped to receive and support the rear of a user's head in such a way that the user's neck muscles are in a relaxed state and the spine is in proper orthopedic alignment when the user is laying horizontally on the user'back.

A first side section 42 is provided. The first side section 42 has a proximal face 46, a distal face, a front face 34, a back face, a first face 50 and a second face. Each face has at least one edge. Each edge is joined to an adjacent edge at a multiplicity of joining spots to form at least one cell. Each cell is fabricated from a flexible, air impervious material. Each cell has at least one opening therein adapted to selectively open and close for receiving and expelling air. The proximal face 46 has a forward attachment area. The second face of the first side section 42 is attached to the first face of the center section 14.

A second neck-support section 62 is provided. The second neck-support section 62 has a cylindrical proximal face 66, a flat distal face, a first end face and a second end face. Each face has at least one edge. Each edge is joined to an adjacent edge at a multiplicity of joining spots to form at least one cell. Each cell is fabricated from a flexible, air impervious material. Each cell has at least one opening therein adapted to selectively open and close for receiving and expelling air. The distal face of the second neck-support section 62 is attached to the forward attachment area of the proximal face 46 of the first side section 42.

The first side section 42 and the second neck-support section 62 are disposed, sized and shaped to receive and support the side of a user's head in such a way that the user's neck muscles are in a relaxed state and the spine is in proper orthopedic alignment when the user is laying horizontally on the user's side.

A first support section 70 is provided. The first support section 70 has a proximal face, a distal face, a front face 74, a back face, a first face 78 and a second face. Each face has at least one edge. Each edge is joined to an adjacent edge at a multiplicity of joining spots to form at least one cell. Each cell has at least one opening therein adapted to selectively open and close for receiving and expelling air. Each cell is fabricated from a flexible, air impervious material. The proximal face of the first support section 70 is attached to the distal face of the center section 14, the distal face of the upper back-support section 22 and the distal face of the first side section 42.

In a variant of this invention, a second side section 82 provided. The second side section 82 a proximal face 86, distal face, a front face 90, back face, a first face and a second face. Each face has at least one edge. Each edge is joined to an adjacent edge at a multiplicity of joining spots to form at least one cell. Each cell is fabricated from a flexible, air impervious material. Each cell has at least one opening therein adapted to selectively open and close for receiving and expelling air. The proximal face 86 has a forward attachment area. The first face of the second side section 82 is attached to the second face of the center section 14.

A third neck-support section 94 is provided. The third neck-support section 94 has a cylindrical proximal face 98, a flat distal face, a first end face and a second end face. Each face has at least one edge. Each edge is joined to an adjacent edge at a multiplicity of joining spots to form at least one cell. Each cell is fabricated from a flexible, air impervious material. Each cell has at least one opening therein adapted to selectively open and close for receiving and expelling air. The distal face of the third neck-support section 94 is attached to the forward attachment area of the proximal face 86 of the second side section 82.

The second side section 82 and third neck-support section 94 are disposed, sized and shaped to receive and support the side of a user's head in such a way that the user's neck muscles are in a relaxed state and the spine is in proper orthopedic alignment when the user is laying horizontally on the user's side.

In yet another variant of this invention, a second support section 94 is provided. The second support section 94 has a proximal face, a distal face, a front face 106, a back face, a first face 110 and a second face. Each face has at least one edge. Each edge is joined to an adjacent edge at a multiplicity of joining spots to form at least one cell. Each cell has at least one opening therein adapted to selectively open and close for receiving and expelling air. Each cell is fabricated from a flexible, air impervious material. The proximal face of the second support section 94 is attached to the distal face of the first support section 70.

In still another variant of this invention, the proximal face 18 of the center section 14, the proximal face 26 of the upper back-support section 22, the proximal face 46 of the first side section 42, the proximal face 86 of the second side section 82, the proximal face 58 of the first neck support 54, the proximal face 66 of the second neck support 62 and the proximal face 98 of the third neck support 94 are covered by a flocked material. The flocked material is rayon.

In again another variant of this invention, the proximal face 18 of the center section 14, the proximal face 26 of the upper back-support section 22, the proximal face 46 of the first side section 42, the proximal face 86 of the second side section 82, the proximal face 58 of the first neck support 54, the proximal face 66 of the second neck support 62 and the proximal face 98 of the third neck support 94 has a tucked configuration.

In a variation of this invention, the proximal face 18 of the center section 14, the proximal face 26 of the upper back-support section 22, the proximal face 46 of the first side section 42, the proximal face 86 of the second side section 82, the proximal face 58 of the first neck support 54, the proximal face 66 of the second neck support 62 and the proximal face 98 of the third neck support 94 has a ribbed configuration.

The invention also resides in another fluid filled head support 210. The other fluid filled head support 210 includes a center section 214. The center section 214 has a proximal face 218, a distal face, a front face, a back face, a first face and a second face. Each face has at least one edge. Each edge is joined to an adjacent edge at a multiplicity of joining spots. Each face is fabricated from a flexible, air impervious material. The proximal face 218 has a forward attachment area.

A first neck-support section 256 is provided. The neck-support section 256 has a cylindrical proximal face 260, a flat distal face, a first end face and a second end face. Each face has at least one edge. Each edge is joined to an adjacent edge at a multiplicity of joining spots. Each face is fabricated from a flexible, air impervious material. The distal face of the first neck-support section 256 is attached to the forward attachment area of the proximal face 218 of the center section 214.

An upper back-support, section 222 is provided. The upper back-support section 222 has a proximal face 226, a distal face, a back face, a first face 230 and a second face. The distal face has a front edge 236. The upper back-support section 222 has a wedge shape. Each face has at least one edge. Each edge is joined to an adjacent edge at a multiplicity of joining spots. Each face is fabricated from a flexible, air impervious material, The back face of the upper back-support section is attached to the front face of the center section 214. The proximal face 226 slopes up from the front edge 236 of the bottom face to form a smooth transition up to the proximal face 218 of the center section 214.

The center section 214, the first neck-support section 256 and upper back-support section 222 are disposed, sized and shaped to receive and support the rear of a user's head in such a way that the user's neck muscles are in a relaxed state and the spine is in proper orthopedic alignment when the user is laying horizontally on the user's back.

A first side section 240 is provided. The first side section 240 has a proximal face 244, a distal face, a front face 248, a back face, a first face 252 and a second face. Each face has at least one edge. Each edge is joined to an adjacent edge at a multiplicity of joining spots. Each face is fabricated from a flexible, air impervious material, The proximal face 244 has a forward attachment area. The second face of the first side section 240 is attached to the first face of the center section 214.

A second neck-support section 264 is provided. The second neck-support section 264 has a cylindrical proximal face 268, a flat distal face, a first end face and a second end face. Each face has at least one edge. Each edge is joined to an adjacent edge at a multiplicity of joining spots. Each face is fabricated from a flexible, air impervious material. The distal face of the second neck-support section 264 is attached to the forward attachment area of the proximal face 244 of the first side section 240.

The first side section 240 and the second neck-support section 264 are disposed, sized and shaped to receive and support the side of a user's head in such a way that the user's neck muscles are in a relaxed state and the spine is in proper orthopedic alignment when the user is laying horizontally on the user's side.

The center section 214, the upper back-support section 222, the first side section 240, the first neck-support section 256 and the second neck-support section 264 are joined to each adjacent section in such a way as to form at least one cell. Each cell has at least one opening therein adapted to selectively open and close for receiving and expelling air.

A first support section 272 is provided. The first support section 272 has a proximal face, a distal face, a front face 276, a back face, a first face 280 and a second face. Each face has at least one edge. Each edge is joined to an adjacent edge at a multiplicity of joining spots to form at least one cell. Each cell has at least one opening therein adapted to selectively open and close for receiving and expelling air. Each cell is fabricated from a flexible, air impervious material. The proximal face of the first support section 272 is attached to the distal face of the center section 214, to the distal face of the upper back-support section 222 and to the distal face of the first side section 240.

In a variant of this invention, a second side section 284 is provided. The second side section 284 has a proximal face 288, a distal face, a front face 292, a back face, a first face and a second face. Each face has at least one edge. Each edge is joined to an adjacent edge at a multiplicity of joining spots. Each face is fabricated from a flexible, air impervious material. The proximal face 288 has a forward attachment area. The first face of the second side section 284 is attached to use second face of the center section 214.

A third neck-support section 296 is provided. The third neck-support section 296 has a cylindrical proximal face 300, a flat distal face, a first end face and a second end face. Each face has at least one edge. Each edge is joined to an adjacent edge at a multiplicity of joining spots. Each face is fabricated from a flexible, air impervious material. The distal face of the third neck-support section 296 is attached to the forward attachment area of the proximal face 288 of the second side section 284.

The second side section 284 and the third neck-support section 296 are disposed, sized and shaped to receive and support the side of a user's head in such a way that the user's neck muscles are in a relaxed state and the spine is in proper orthopedic alignment when the user is laying horizontally on the user's side.

The center section 214, the upper back-support section 222, the first side section 240, the second side section 284, the first neck-support section 256, the second neck-support section 264 and the third neck-support section 296 are joined to each adjacent section in such a way as to form at least one cell. Each cell has at least one opening therein adapted to selectively open and close for receiving and expelling air.

In yet another variant of this invention, a second support section 304 is provided. The second support section 304 has a proximal face, a distal face, a front face 308, a back face, a first face 312 and a second face. Each face has at least one edge. Each edge is joined to an adjacent edge at a multiplicity of joining spots to form at least one cell. Each cell has at least one opening therein adapted to selectively open and close for receiving and expelling air. Each cell is fabricated from a flexible, air impervious material. The proximal face of the second support section 304 is attached to the distal face of the first support section 272.

In still another variant of this invention, the proximal face 218 of the center section 218, the proximal face 226 of the upper back-support section 222, the proximal face 244 of the first side section 240, the proximal face 288 of the second side section 284, the proximal face 260 of the first neck support 256, the proximal face 268 of the second neck support 264 and the proximal face 300 of the third neck support 296 are covered by a flocked material. The flocked material is rayon.

In again another variant of this invention, the proximal face 218 of the center, section 218, the proximal face 226 of the upper back-support section 222, the proximal face 244 of the first side section 240, the proximal face 288 of the second side section 284, the proximal face 260 of the first neck support 256, the proximal face 268 of the second neck support 264 and the proximal face 300 of the third neck support 296 have a tucked configuration.

In a variation of this invention, the proximal face 218 of the center section 218, the proximal face 226 of the upper back-support section 222, the proximal face 244 of the first side section 240, the proximal face 288 of the second side section 284, the proximal face 260 of the first neck support 256, the proximal face 268 of the second neck support 264 and the proximal face 300 of the third neck support 296 have a ribbed configuration.

The present disclosure includes that contained in the present claims as well as that of the foregoing description. Although this invention has been described in its preferred forms with a certain degree of particularity, it is understood that the present disclosure of the preferred forms has been made only by way of example and numerous changes in the details of construction and combination and arrangement of parts may be resorted to without departing from the spirit and scope of the invention. Accordingly, the scope of the invention should be determined not only by the embodiments illustrated, but by the appended claims and their legal equivalents.

What is claimed is:

1. A fluid filled head support comprising:

a center section having a proximal face, a distal face, a front face, a back face, a first face and a second face, each said face having at least one edge, each said edge being joined to an adjacent edge at a multiplicity of joining spots to form at least one cell, each said cell being fabricated from a flexible, air impervious material, each said cell having at least one opening therein adapted to selectively open and close for receiving and expelling air, said proximal face having a forward attachment area;

a first neck-support section having a cylindrical proximal face, a flat distal face, a first end face and a second end face, each said face having at least one edge, each edge being joined to an adjacent edge at a multiplicity of joining spots to form at least one cell, each said cell being fabricated from a flexible, air impervious material, each said cell having at least one opening therein adapted to selectively open and close for receiving and expelling air, said distal face of said first neck-support section being attached to said forward attachment area of said proximal face of said center section;

an upper back-support section having a proximal face, a distal face, a back face, a first face and a second face, said distal face having a front edge, each said face having at least one edge, each said edge being joined to an adjacent edge at a multiplicity of joining spots to form at least one cell, each said cell being fabricated from a flexible, air impervious material, each said cell having at least one opening therein adapted to selectively open and close for receiving and expelling air, said back face of said upper back-support section being attached to said front face of said center section, said upper back-support section having a wedge shape, said proximal face slopes up from said front edge of said bottom face to form a smooth transition up to said proximal face of said center section;

said center section, said first neck-support section and said upper back-support section being disposed, sized and shaped to receive and support the rear of a user's head in such a way that the user's neck muscles are in a relaxed state and the spine is in proper orthopedic alignment when the user is laying horizontally on the user's back;

a first side section having a proximal face, a distal face, a front face, a back face, a first face and a second face, each said face having at least one edge, each said edge being joined to an adjacent edge at a multiplicity of joining spots to form at least one cell, each said cell being fabricated from a flexible, air impervious material, each said cell having at least one opening therein adapted to selectively open and close for receiving and expelling air, said proximal face having a forward attachment area, said second face of said first side section being attached to said first face of said center section;

a second neck-support section having a cylindrical proximal face, a flat distal face, a first end face and a second end face, each said face having at least one edge, each edge being joined to an adjacent edge at a multiplicity of joining spots to form at least one cell, each said cell being fabricated from a flexible, air impervious material, each said cell having at least one opening therein adapted to selectively open and close for receiving and expelling air, said distal face of said second neck-support section being attached to said forward attachment area of said proximal face of said first side section;

said first side section and second neck-support section being disposed, sized and shaped to receive and support the side of a user's head in such a way that the user's neck muscles are in a relaxed state and the spine is in proper orthopedic alignment when the user is laying horizontally on the user's side; and a first support section having a proximal face, a distal face, a front face, a back face, a first face and a second face, each said face having at least one edge, each edge being joined to an adjacent edge at a multiplicity of joining spots to form at least one cell, each said cell having at least one opening therein adapted to selectively open and close for receiving and expelling air, and each said cell being fabricated from a flexible, air impervious material, said proximal face of said first support section being attached to said distal face of said center section, said distal face of said upper back-support section and said distal face of said first side section.

2. A fluid filled head support according to claim 1 further comprising:

a second side section having a proximal face, a distal face, a front face, a back face, a first face and a second face, each said face having at least one edge, each said edge being joined to an adjacent edge at a multiplicity of joining spots to form at least one cell, each said cell being fabricated hold a flexible, air impervious material, each said cell having at least one opening therein adapted to selectively open and close for receiving and expelling air, said proximal face having a forward attachment area, said first face of said second side section being attached to said second face of said center section; and a third neck-support section having a cylindrical proximal face, a flat distal face, a first end face and a second end face, each said face having at least one edge, each edge being joined to an adjacent edge at a multiplicity of joining spots to form at least one cell, each said cell being fabricated from a flexible, air impervious material, each said cell having at least one opening therein adapted to selectively open and close for receiving and expelling air, said distal face of said third neck-support section being attached to said forward attachment area of said proximal face of said second side section; and said second side section and said third neck-support section being disposed, sized and shaped to receive and support the side of a user's head in such a way that the user's neck muscles are in a relaxed state and the spine is in proper orthopedic alignment when the user is laying horizontally on the user's side.

3. A fluid filled head support according to claim 2 wherein said proximal face of said center section, said proximal face of said upper back-support section, said proximal face of said first side section, said proximal face of said second side section, said proximal face of said first neck support, said proximal face of said second neck support and said proximal face of said third neck support being covered by a flocked material.

4. A fluid filled head support according to claim 3 wherein said flocked material being selected from the group consisting of rayon, cotton, acetate, silk and wool.

5. A fluid filled head support according to claim 3 wherein said flocked material being, selected from the group consisting of rayon, cotton, acetate, silk and wool.

6. A fluid filled head support according to claim 2 wherein said proximal face of said center section, said proximal face of said upper back-support section, said proximal face of said first side section, said proximal face of'said second side section, said proximal face of said first neck support, said proximal face of said second neck support and said proximal face of said third neck support having a tucked configuration.

7. A fluid filled head support according to claim 2 wherein said proximal face of said center section, said proximal face of said upper back-support section, said proximal face of said first side section, said proximal face of said second side section, said proximal face of said first neck support, said proximal face of said second neck support and said proximal face of said third neck support having a ribbed configuration.

8. A fluid filled head support according to claim 1 further comprising a second support section having a proximal face, a distal face, a front face, a back face, a first face and a second face, each said face having at least one edge, each edge being joined to an adjacent edge at a multiplicity of joining spots to form at least one cell, each said cell having at least one opening therein adapted to selectively open and close for receiving and expelling air, and each said cell being fabricated from a flexible, air impervious material, said proximal face being attached to said distal face of said first support section.

9. A fluid filled head support comprising:

a center section having a proximal face, a distal face, a front face, a back face, a first face and a second face, each said face having at least one edge, each said edge being joined to an adjacent edge at a multiplicity of joining spots, each said face being fabricated from a flexible, air impervious material, said proximal face having a forward attachment area;

a first neck-support section having a cylindrical proximal face, a flat distal face, a first end face and a second end face, each said face having at least one edge, each edge being joined to an adjacent edge at a multiplicity of joining spots, each said face being fabricated from a flexible, air impervious material, said distal face of said first neck-support section being attached to said forward attachment area of said proximal face of said center section, an upper back-support section having a proximal face, a distal face, a back face, a first face and a second face, said distal face having a front edge, each said face having at least one edge, each said edge being joined to an adjacent edge at a multiplicity of joining spots, each said face being fabricated from a flexible, air impervious material, said back face of said upper back-support section being attached to said front face of said center section, said upper back-support section having a edge shape, said proximal face slopes up from said front edge of said bottom face to form a smooth transition up to said proximal face of said center section;

said center section, said first neck-support section and said upper back-support section being disposed, sized and shaped to receive and support the rear of a user's head in such a way that the user's neck muscles are in a relaxed state and the spine is in proper orthopedic alignment when the user is laying horizontally on the user's back;

a first side section having a proximal face, a distal face, a front face, a back face, a first face and a second face, each said face having at least one edge, each said edge being joined to an adjacent edge at a multiplicity of joining spots, each said face being fabricated from a flexible, air impervious material, said proximal face having a forward attachment area, said second face of said first side section being attached to said first face of said center section;

a second neck-support section having a cylindrical proximal face, a flat distal face, a first end face and a second end face, each said face having at least one edge, each edge being joined to an adjacent edge at a multiplicity of joining spots, each said face being fabricated from a flexible, air impervious material, said distal face of said second neck-support section being attached to said forward attachment area of said proximal face of said first side section;

said first side section and said second neck-support section being disposed, sized and shaped to receive and support the side of a user's head in such a way that the user's neck muscles are in a relaxed state and the spine is in proper orthopedic alignment when the user is laying horizontally on the user's side;

said center section, said upper back-support section, said first side section, said first neck-support section and said second neck-support section being joined to each adjacent section in such a way as to form at least one cell, each said cell having at least one opening therein adapted to selectively open and close for receiving and expelling air; and a first support section being provided, said first support section having a proximal face, a distal face, a front face, a back face, a first face and a second face, each said face having at least one edge, each edge being joined to an adjacent edge at a multiplicity of joining spots to forth at least one cell, each said cell having at least one opening therein adapted to selectively open and close for receiving and expelling air, and each said cell being fabricated from a flexible, air impervious materials said proximal face of said first support section being attached to said distal face of said center section, said distal face of said upper back-support section and said distal face of said first side section.

10. A fluid filled head support according to claim 9 further comprising:

a second side section having a proximal face, a distal face, a front face, a back face, a first face and a second face, each said face having at least one edge, each said edge being joined to an adjacent edge at a multiplicity of joining spots, each said face being fabricated from a flexible, air impervious material, said proximal face having a forward attachment area, said first face of said second side section being attached to said second face of said center section, said center section, said upper back-support section, said first side section, said second side section, said first neck-support section and said second neck-support section being joined to each adjacent section in such a way as to form at least one cell, each said cell having at least one opening therein adapted to selectively open and close for receiving and expelling air;

a third neck-support section having a cylindrical proximal face, a flat distal face, a first end face and a second end face, each said face having at least one edge, each edge being joined to an adjacent edge at a multiplicity of joining spots, each said face being fabricated from a flexible, air impervious material, said distal face of said third neck-support section being attached to said forward attachment area of said proximal face of said second side section, said center section, said upper back-support section, said first side section, said second side section, said first neck-support section, said second neck-support section and said third neck-support section being joined to each adjacent section in such a way as to form at least one cell, each said cell having at least one opening therein adapted to selectively open and close for receiving and expelling air; and said second side section and said third neck-support section being disposed, sized and shaped to receive and support the side of a user's head in such a way that the user's neck muscles are in a relaxed state and the spine is in proper orthopedic alignment when the user is laying horizontally on the user's side.

11. A fluid filled head support according to claim 10 wherein said proximal face of said center section, said proximal face of said upper back-support section, said proximal face of said first side section, said proximal face of said second side section, said proximal face of said first neck support, said proximal face of said second neck support and said proximal face of said third neck support being covered by a flocked material.

12. A fluid filled head support according to claim 10 further comprising a second support section having a proximal face, a distal face, a front face, a back face, a first face and a second face, each said face having at least one edge, each edge being joined to an adjacent edge at a multiplicity of joining spots to form at least one cell, each said cell having at least one opening therein adapted to selectively open and close for receiving and expelling air, and each said cell being fabricated from a flexible, air impervious material, said proximal face of said second support section being attached to said distal face of said first support section.

13. A fluid filled head support according to claim 10 wherein said proximal face of said center section, said proximal face of said upper back-support section, said proximal face of said first side section, said proximal face of said second side section, said proximal face of said first neck support, said proximal face of said second neck support and said proximal face of said third neck support having a tucked configuration.

14. A fluid filled head support according to claim 10 wherein said proximal face of said center section, said proximal face of said upper back-support section, said proximal face of said first side section, said proximal face of said second side section, said proximal face of said first neck support, said proximal face of said second neck support and said proximal face of said third neck support having a ribbed configuration.

* * * * *